US005875729A

United States Patent [19]

Simola

[11] Patent Number: 5,875,729

[45] Date of Patent: Mar. 2, 1999

[54] STABILIZED FLOAT DRUM

[76] Inventor: Charles H. Simola, P.O. Box 147, Speculator, N.Y. 12164

[21] Appl. No.: 972,607

[22] Filed: Nov. 18, 1997

Related U.S. Application Data

[63] Continuation-in-part of Ser. No. 770,947, Dec. 18, 1996, Pat. No. 5,775,248.

[51] Int. Cl.[6] ..... B63B 35/44

[52] U.S. Cl. ..... 114/267; 114/263

[58] Field of Search ..... 114/121, 122, 114/126, 263, 266, 267

[56] References Cited

U.S. PATENT DOCUMENTS

| | | | |
|---|---|---|---|
| 1,299,186 | 4/1919 | Imaizumi | 114/126 |
| 3,323,479 | 6/1967 | Filak | 114/5 |
| 3,986,471 | 10/1976 | Haselton | 114/126 |
| 4,061,102 | 12/1977 | Bissett | 114/122 |
| 4,823,719 | 4/1989 | Sarwe | 114/126 |
| 5,653,188 | 8/1997 | Molin | 114/266 |

OTHER PUBLICATIONS

NYS Dept. of Environmental Conservation Dwg. Project #14–2755 Nov. 1996.

*Primary Examiner*—Ed L. Swinehart
*Attorney, Agent, or Firm*—Robert O. Wright

[57] ABSTRACT

A stabilized float drum is shown having interlocking side and end walls and an upper compartment filled with a flotation medium such as closed cell foam and a lower member with a selected number and size of holes in the surfaces thereof to admit water which then acts as a stabilizing force when the float is subjected to upsetting wave action or eccentric loads. The degree of stabilization or damping is controlled by the relative size of the lower member and the size, placement and number of holes.

Various baffle members are shown which provide varying degrees of resistance to unwanted displacement of floating docks.

8 Claims, 8 Drawing Sheets

STABILIZED FLOAT DRUM

This application is a continuation-in-part of application Ser. No. 08/770,947, filed Dec. 18, 1996, now U.S. Pat. No. 5,775,248.

This invention relates to buoyant float drums for use in marine structures and more particularly to a stabilized float drum and floating dock construction that resists tipping under eccentric loads.

BACKGROUND OF INVENTION

For many years floating docks have been constructed utilizing sealed containers of air such as barrels and more recently blocks of foam such as styrofoam. Because of damage to and from wildlife, foam floats now generally consist of blocks of closed cell foam encapsulated within a plastic skin or covering to provide the desired flotation. Such air or foam blocks have been economical and easy to use as modular blocks in dock building but have generally resulted in relatively unstable platforms particularly when several people attempt to stand along one edge of an elongated dock. The tipping or tilting of the dock, especially narrower ones has been a persistent problem.

One attempt to solve this problem in a floating dock is shown in U.S. Pat. No. 5,347,948 to Rytand. Rytand shows spaced apart longitudinal beams or stringers forming elongated chambers in which he places foam blocks so as to fill the upper two thirds of the chamber. The lower one third of the chambers are allow to fill with water by seepage when the dock is installed. The water tends to act as ballast. The longitudinal beams tend to limit longitudinal deflection and the ballast tends to limit lateral tipping. This construction however is cumbersome to make and handle, especially out of the water, and is limited in the sizes and shapes that can be easily and economically made.

Another attempt to stabilize a floating dock structure is shown in NY State Department of Environmental Conservation Dwg "Town of Bethlehem" dated November 1996. Here a flat butterfly plate has been mounted across the width of a dock with a number of holes formed therein. The performance of this butterfly plate is unknown but it would appear to offer some improvement in stability of the dock structure.

OBJECTS AND BRIEF DESCRIPTION

Accordingly it is an object of the present invention to provide a buoyant float drum and dock construction that overcomes the limitations of the prior art.

It is another object of the present invention to provide a buoyant float drum and dock construction that results in greatly improved stability.

It is another object of the present invention to provide an apparatus and method of stabilizing a buoyant structure positioned in a fluid.

It is another object of the present invention to provide an improved stabilizing baffle member that may be attached to any floating structure to stabilize same from eccentric loads and or wave action.

It is another object of the present invention to provide a buoyant float drum, utilizing a block of closed cell foam, and having improved stability.

It is a further object of the present invention to provide a stabilized buoyant float drum and floating dock using same that resists tipping and tilting due to eccentric loads and wave action.

It is a still further object of the present invention to provide a modular stabilized float drum that can be made in high volume, economical production for easy assembly on site into a stable floating dock structure.

Still another object of the invention is to provide a means of stabilizing a float drum that can easily be matched to both the frequency and amplitude of unbalancing forces acting thereon.

These and other and further objects of the invention are accomplished in one embodiment of the invention by a buoyant float drum having an upper compartment filled with a closed cell foam and a lower compartment empty but with a number of holes of preselected size formed in the surfaces of the lower compartment to provide water access to and from the compartment.

DESCRIPTION OF PREFERRED EMBODIMENT

Figure 1:
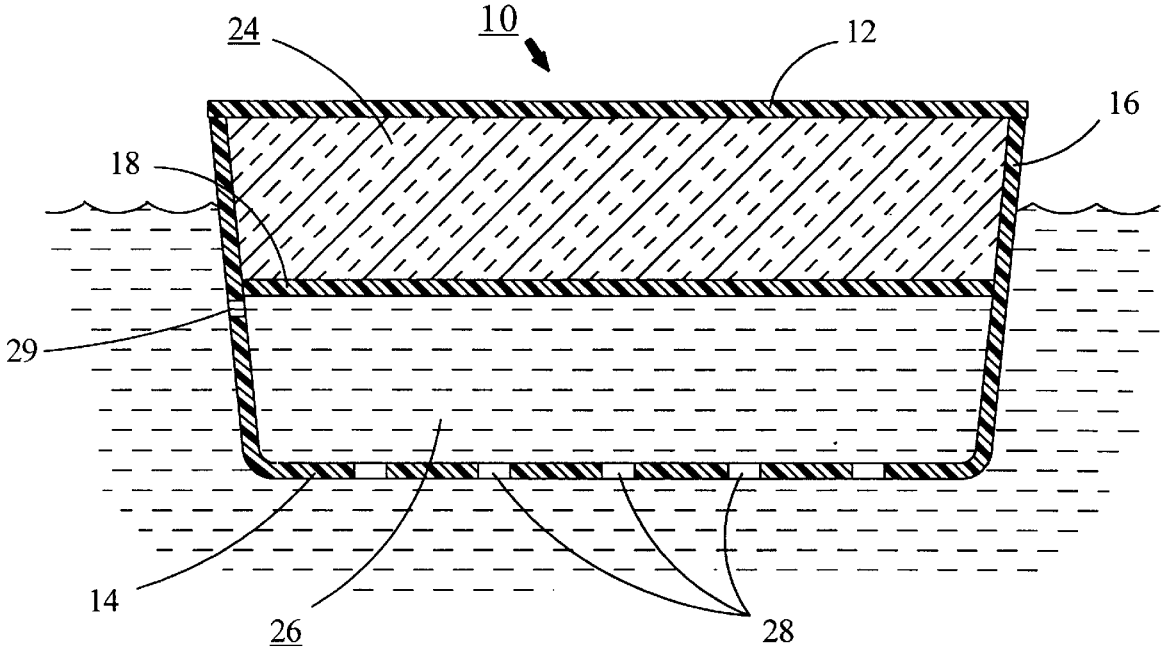
FIG. 1 is a cross sectional view of a float drum taken on line 1—1 of FIG. 2.

Referring now to FIG. 1 there is shown in cross section a float drum 10 according to the present invention. As may be seen in FIGS. 1–3 drum 10 is in the form of a rectangular box having top 12, bottom 14, side and end walls 16, and a partition 18. Partition 18 divides drum 10 into an upper compartment 20 and a lower compartment 22. Upper compartment 20 is filled with a floatation medium. This may be air or preferably a closed cell EPS foam 24. Lower compartment 22 is filled with water 26 from the body of water in which the drum is floated. One or more holes 28 are formed in the bottom or sides of the lower compartment to admit water 26 when the drum is placed in a body of water and to restrict discharge therefrom.

Drum 10 is preferably made from a moldable plastic such as polyethylene, polyvinylchloride, or other suitable material generally impervious to fresh and/or salt water. Foam 24 may be a polyurethane, polystyrene or other suitable closed cell foam that will not take on significant amounts of water. The foam 24 is completely enclosed within compartment 20 to inhibit attack by wild life and to meet Army Corp of Engineers Specifications.

Holes 28 are chosen both in size, number, and placement to restrict water access and movement to provide the desired amount of damping of movement of float 10 and any dock structure formed therewith. By proper selection various types of upsetting forces such as wave action, wind forces, and eccentric deck loads can be greatly reduced. Also the relative size of the two compartments is chosen to meet specific upsetting conditions as well as load carrying requirements.

Figure 2:
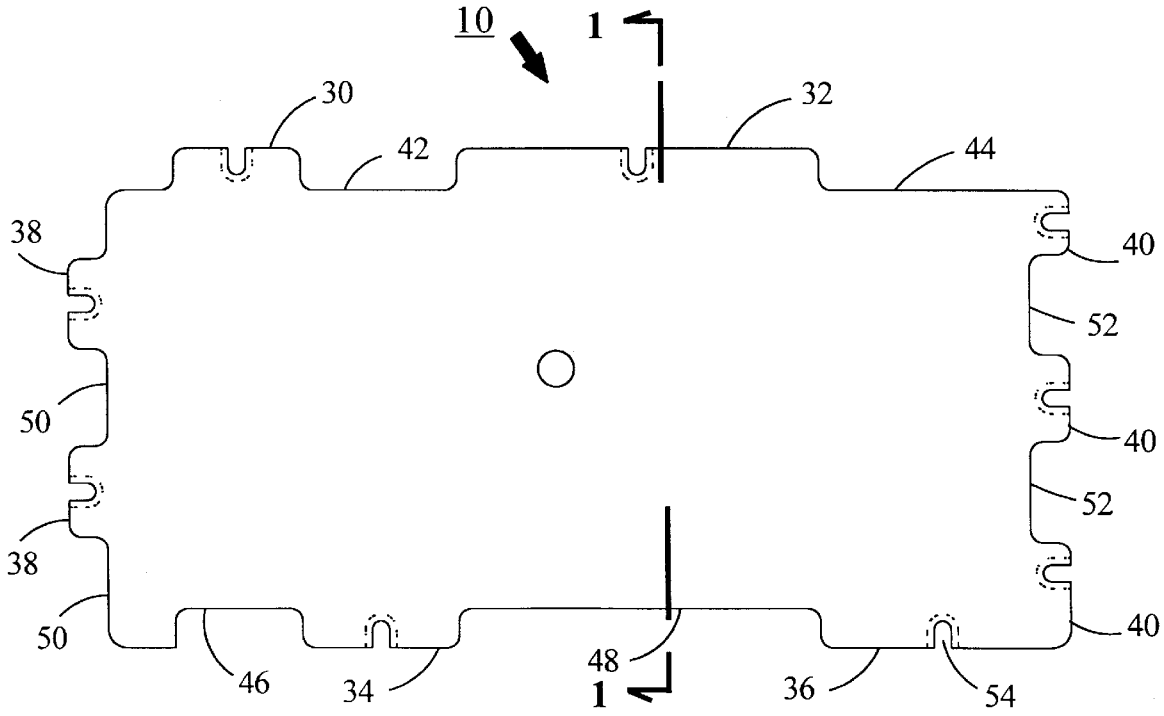
FIG. 2 is a top plan view of the float of FIG. 1.
Figure 7:
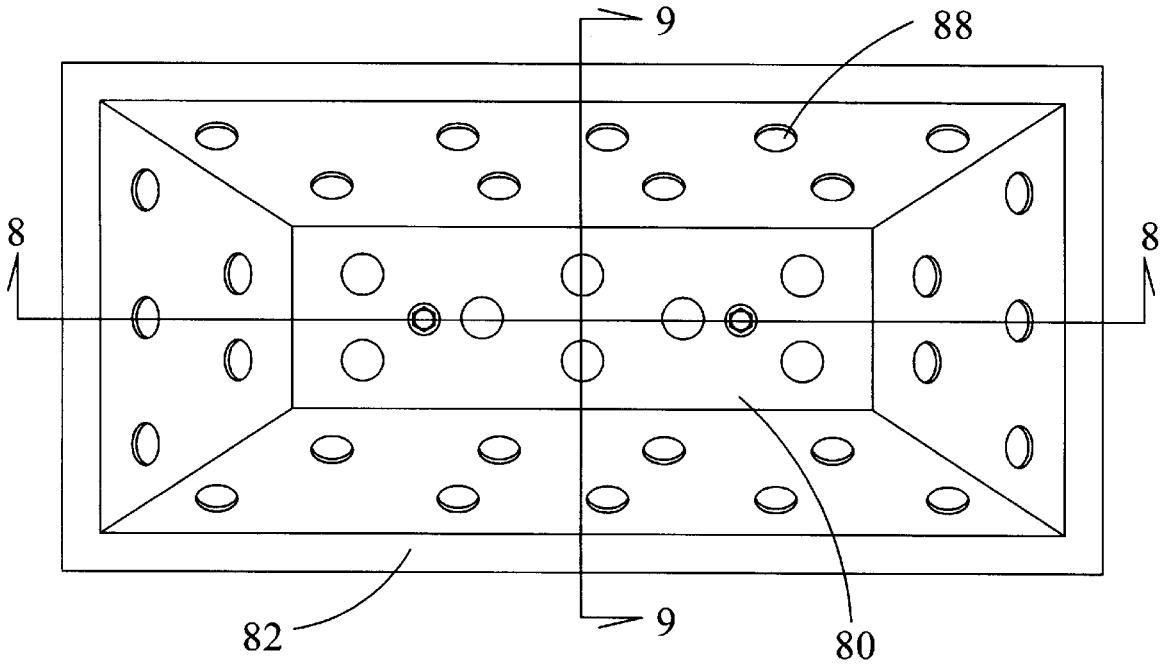
FIG. 7 is a bottom view of a floating dock structure, partially broken away, showing a stabilizing tray member according to the present invention.

As shown in FIG. 2, a series of lugs or flanges 30–40 are provided which extend outwardly from the top edge of drum 10 and form recesses 42–52. The lugs and recesses are positioned so that when two or more float drums are positioned side by side or end to end the upper edges interlock to form a continuous upper surface for a floating dock or the like. As shown in FIG. 7, lug 34 will fit in recess 42, lug 36 in recess 44, lugs 38 in recesses 52, and lugs 40 in recesses 50. Slots 54 are provided in the various lugs through which bolts or screws (not shown) may be inserted to secure the drums 10 to the framework of a marine structure, such as stringers 55. Stringers 55 will extend longitudinally along the length of the dock and the floats 10 on either side are secured thereto from underneath. Thus a single stringer may be shared by two rows of float drums in constructing a dock instead of each row of drums requiring its own stringers to join them into a dock structure. A dock surface 57 is then mounted on the top of the stringers 55. Surface 57 may be planks, plywood or metal fastened to the top of the stringers 55.

Float drums 10 are molded with their outer wall surfaces extending out to the edges of the flanges and recesses so that when interlocked at the flanges not only is a flat upper surface formed but also the corresponding adjacent wall lugs and recesses interlock with minimal taper clearances to form an almost solid dock structure. A superior dock structure results even with float drums without stabilizing compartments.

Figure 3:
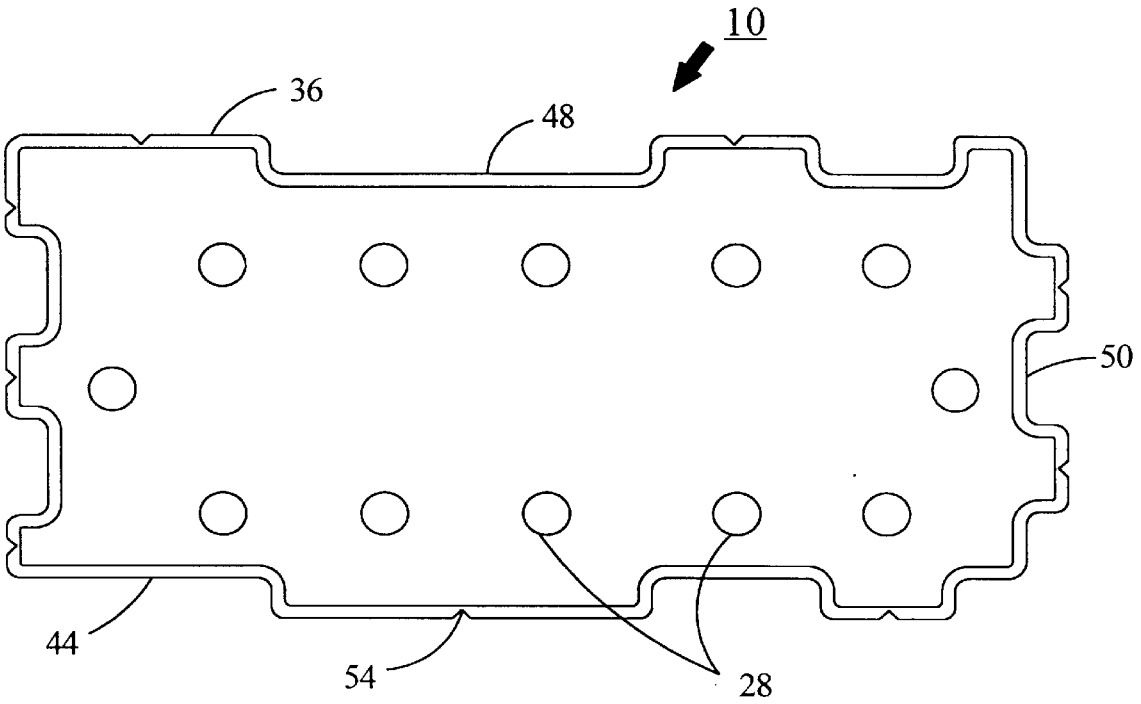
FIG. 3 is a bottom plan view of the float of FIG. 1.

Holes 28 may be seen in FIG. 3 spaced around the periphery of the drum 10 and the size and number are chosen to provide the desired damping effect by controlling the time it takes for water captured in the lower space 26 to flow out of and into said space as the drum is moved up and down in the body of water in which it is floating. Upon initial placement of the drum 10 in a body of water it will slowly sink to the equilibrium depth shown in FIG. 1 for a particular load condition. Vertical and lateral displacement of drum 10 will be resisted by the water in compartment 26 proportional to the number, placement and sizes of holes 28. In order for float 10 to assume its designed position in the water small weep holes 29 may be provided adjacent the upper wall of the lower compartment to permit any trapped air to escape.

While I have shown the upper compartment 20 filled with closed cell foam 24 the compartment 20 can be sealed containing air only and equivalent floatation achieved. In some constructions the principal function of the foam is to stiffen and structurally reinforce the walls of compartment 20. In this construction the foam also serves as a backup flotation in the event of a leak in the upper compartment. In an air only float the walls usually are thicker and internal stiffeners are provided.

Figure 4:
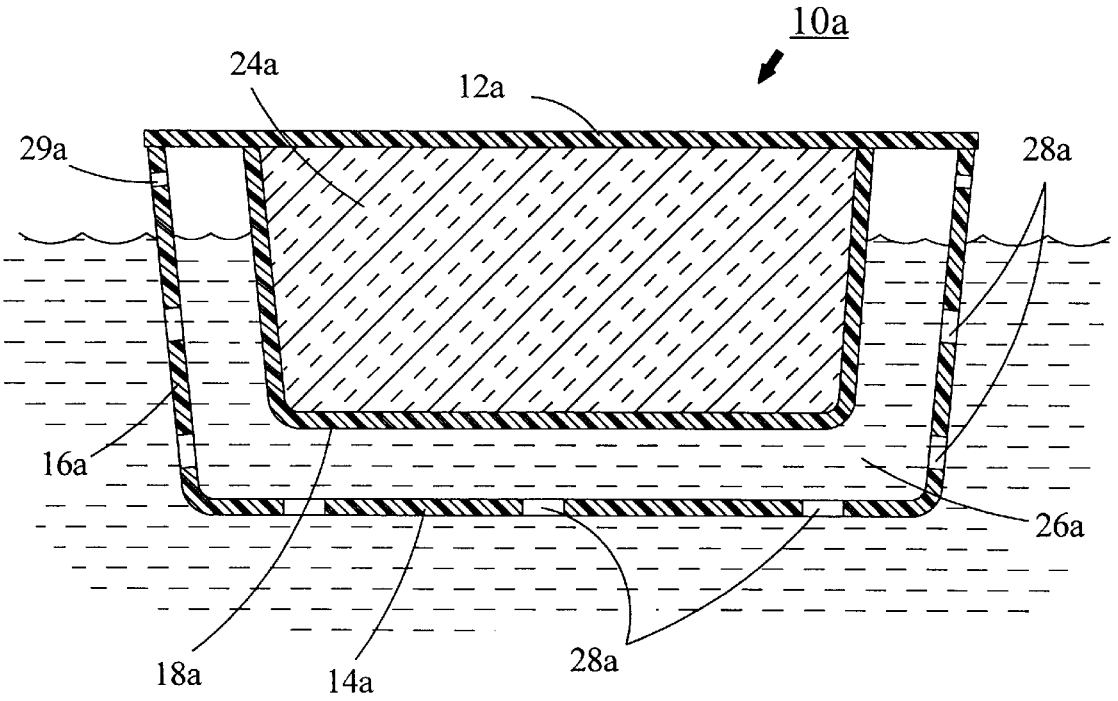
FIG. 4 is a view similar to FIG. 1 of another embodiment of the present invention.

Referring now to FIG. 4, there is shown another embodiment of the present invention. Here drum 10*a* is formed with the upper compartment 24*a* centered within the outer walls. Partition 18*a* forms a sealed internal flotation chamber within float drum 10*a*, suspended under top 12*a*. Holes 28*a* may be positioned in the bottom 14*a* and the sidewalls 16*a* as desired along with weep holes 29*a* just below the top 12*a* as needed. The added height of the water column within drum 10*a* will for some situations result in additional stabilization.

It should be noted that the horizontal bottom and vertical sides of the second compartment in at least some applications form resistance plates to unwanted momentary movement of the float drum and thus stabilize the float drum in the water. The baffles of the embodiment shown in FIGS. 5 & 6 perform a similar function for at least vertical displacement of the float drum in water. In both embodiments the second compartment and the baffles are substantially neutral buoyancy, neither adding to nor subtracting from the buoyancy of the float drum.

Figure 5:
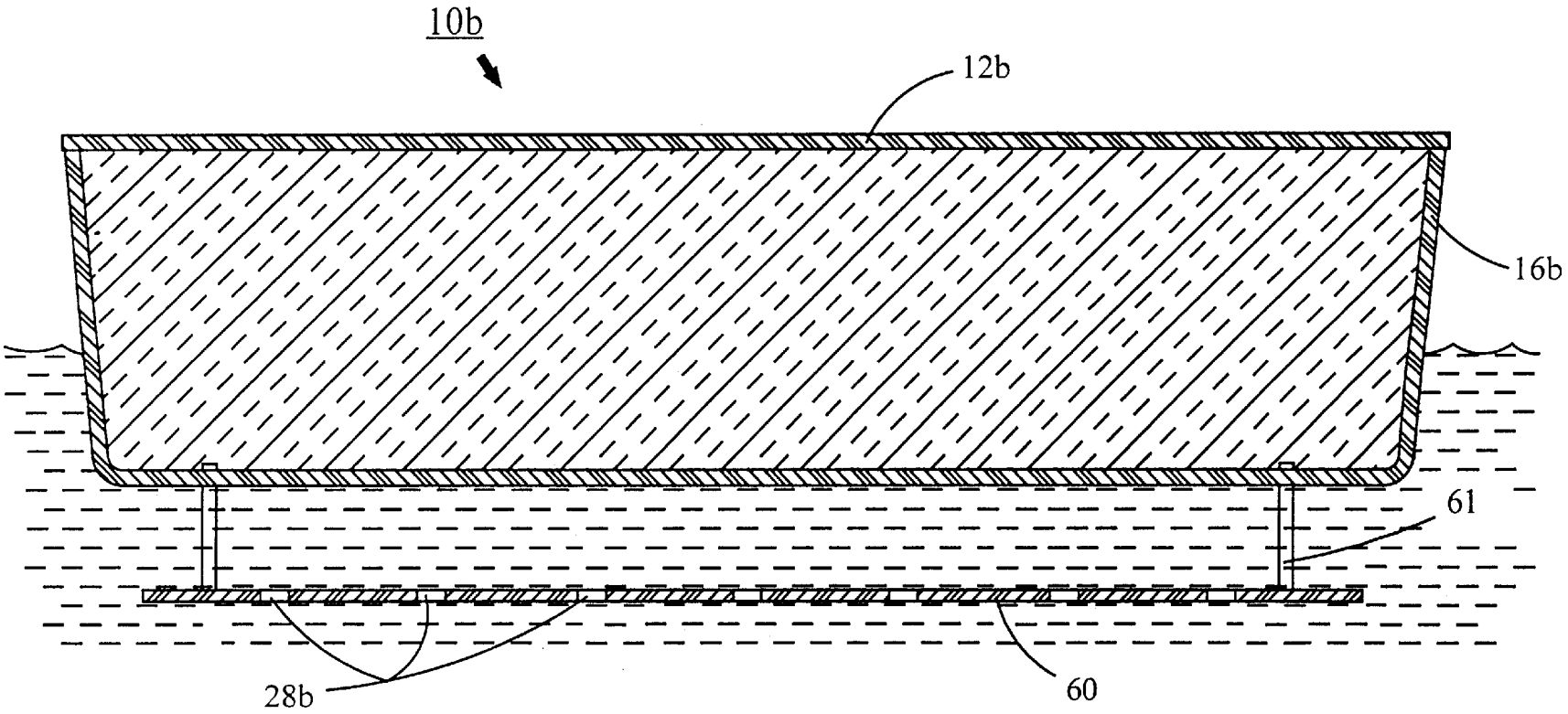
FIG. 5 is a cross sectional view of another embodiment of the present invention.

FIG. 5 shows another embodiment in which stabilization baffles 60 are hung from the foam filled float drum 10*b* on struts 61. Baffles 60 may have holes 28*b* in the bottom thereof to permit water flow therethrough as the drum 10*b* is placed in a body of water. It has been found that for certain applications baffles 60 will offer a similar resistance to displacement of the drum 10*b* as the compartment 26 does for the drum 10. It is believed that baffles 60 offer more of a frictional resistance to abrupt movement of the float drum 10*b* and are preferred for certain applications. The holes 28*b* ease initial installation.

Figure 6:
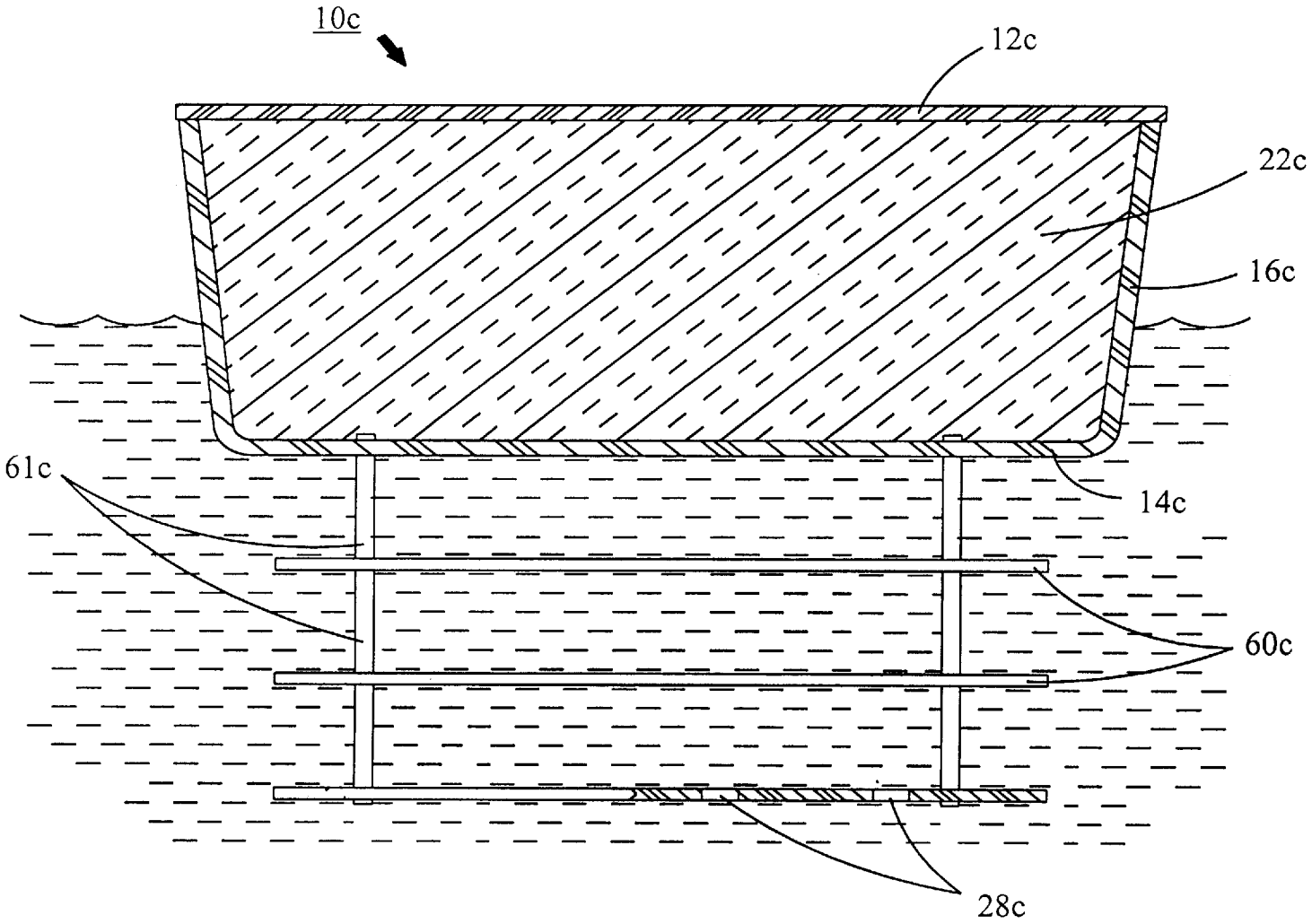
FIG. 6 is a cross sectional view of a still further embodiment of the present invention.

In FIG. 6 a series of baffles 60*c* are mounted below float drum 10*c*. The three baffles 60*c* shown provide additional resistance to abrupt movement of drum 10*c* vertically when positioned in the water. The spacing of the baffles may be adjusted to counteract specific conditions to be encountered.

The foregoing embodiments have been shown and described as made from various plastics. Floats, especially barrels and larger ones have been made from steel, aluminum, stainless steel etc. for many years. Obviously where advantageous the float drums of the present invention could be made of the same materials.

The configurations shown in FIGS. 1 & 5 are preferred construction for buoyant float drums to be used to counteract eccentric loads in a dock structure. Where the primary objective is to damp wave or wind action the FIG. 1 construction with lower compartment 22 made much deeper relative to the upper compartment 20 would be used. Instead of the upper compartment comprising two thirds of the total it might be only one fifth of the total. A dock constructed with such float drums could function almost as a breakwater for instance.

Figure 8:
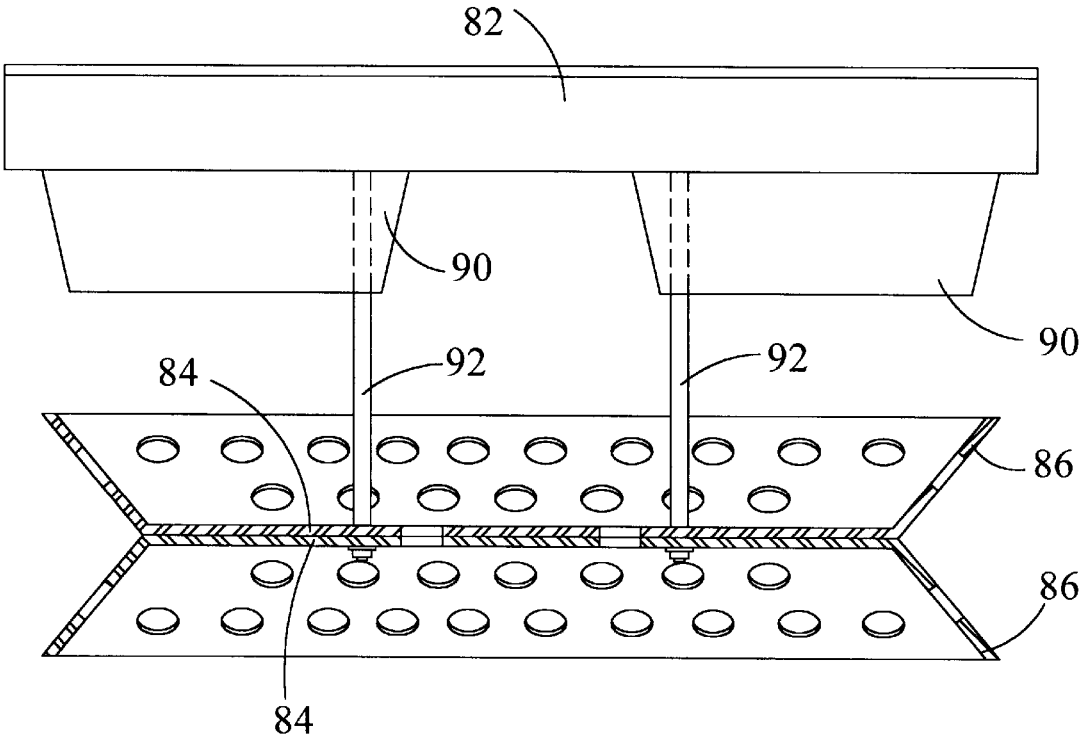
FIG. 8 is a sectional view taken on line 8—8 of FIG. 7.
Figure 9:
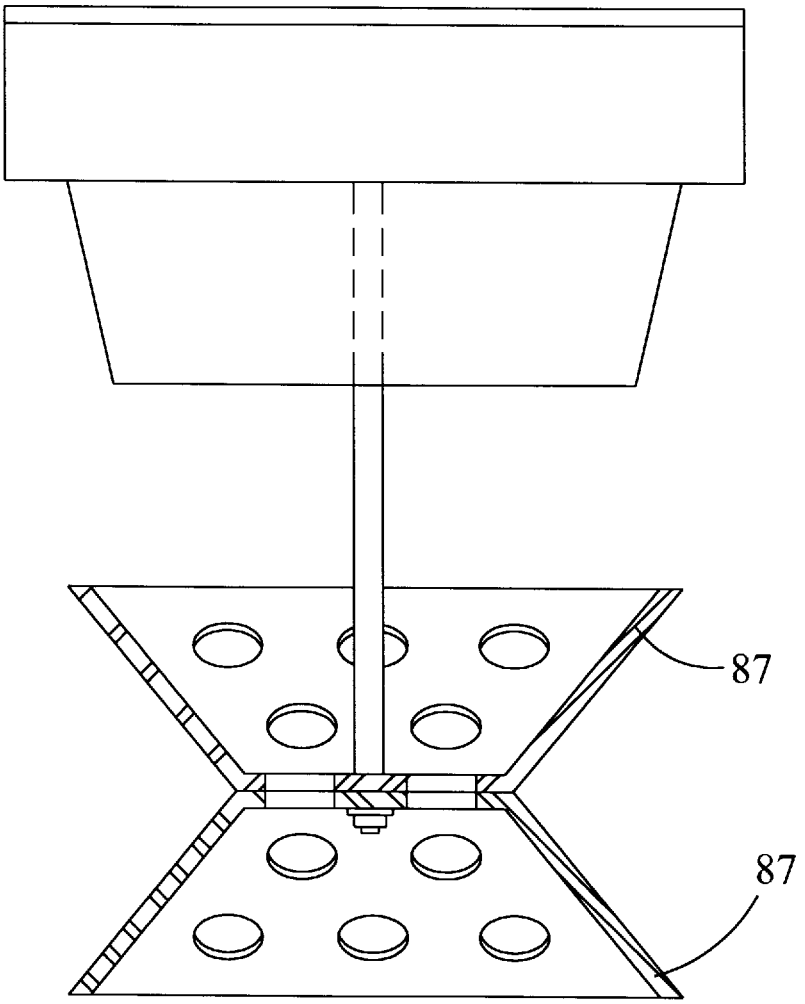
FIG. 9 is a sectional view taken on line 9—9 of FIG. 7.

Referring now to FIG. 7 a baffle member 80 is shown attached to the under side of a floating dock 82. Baffle member 80 is formed from a pair of tray like members 84 fixed back to back with the ends 86 and sides 87 bent at an angle of about forty five degrees(See FIGS. 8 & 9). A series of holes 88 are formed throughout the surface of plate 84 including ends 86 and sides 87. Baffle member 80 extends from side to side of dock 82 and underlies the two float drums 90 and is attached to the dock frame by struts 92 which may be bolted or otherwise secured to the plate 84 and frame of the dock 82. Baffle member 80 is spaced below the bottom of the float drums providing buoyancy for the dock structure, a distance of from six inches to thirty inches with eighteen inches being preferred for most applications. Ends 86 and sides 87 are bent at angles from thirty to ninety degrees from bottom 84. Plates 84 typically will measure two feet by four feet and when made of a reinforced plastic have a thickness of one quarter to three quarters of an inch. The exact span of member 80 may extend under several float drums and the method of fastening member 80 to the dock or other structure may be adapted to the particular dock construction and use.

Other sizes, spacings and materials may be used for different applications. One interesting application of this construction appears to be in forming a breakwater for protecting anchorages for small boats on a lake or river.

Figure 10:
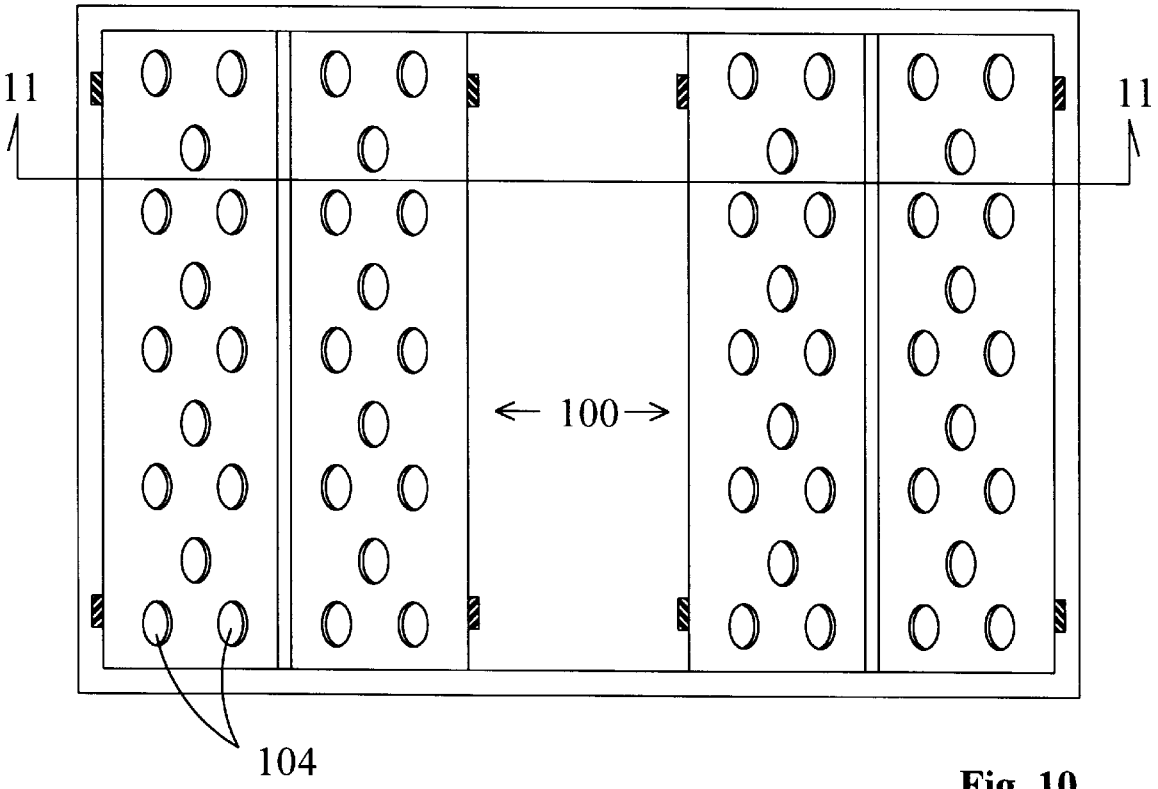
FIG. 10 is a view similar to FIG. 7 of another embodiment of the present invention.
Figure 11:
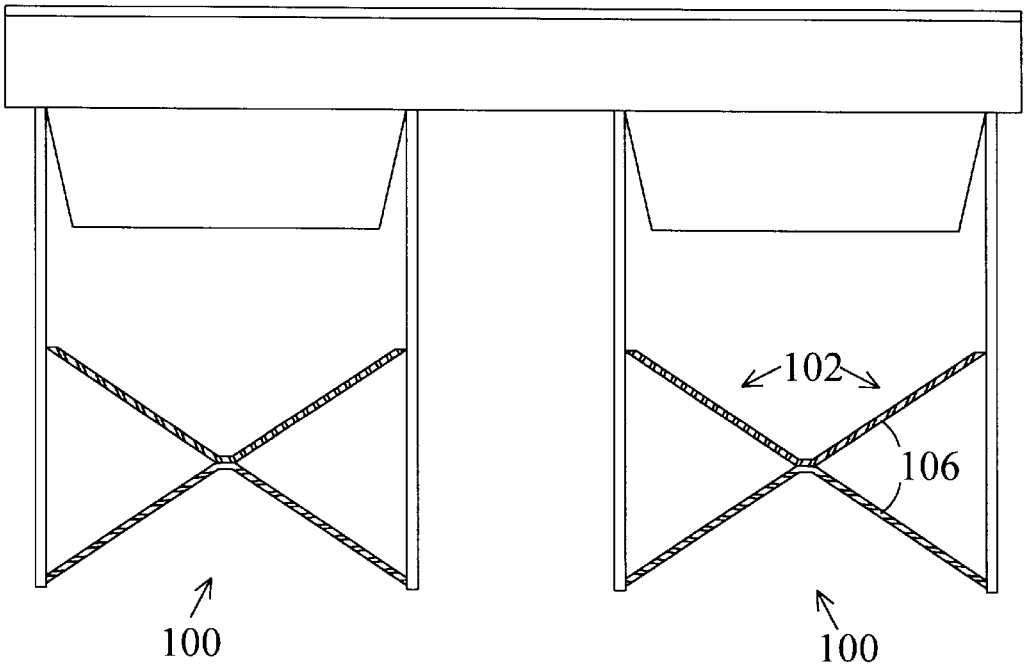
FIG. 11 is a sectional view taken on lint 11—11 of FIG. 10.

Referring now to FIGS. 10 and 11 there is shown another form of baffle member namely individual baffles 100 fixed beneath the floats 90. Baffles 100 are formed by a pair of vee shaped troughs 102 welded or otherwise fixed together, in back to back relationship forming a sort of "X" shape in cross section. The surface of troughs 102 have a number of holes 104 formed therein In use it has been found that the use of baffle members 80 and 100 greatly reduce the rate of deflection of a floating dock structure when a load, such as a person or persons standing along one edge, is applied to it. The flat bottom portion 84 provides substantial frictional resistance to movement of the dock structure vertically through the water although eventually the dock structure will settles into the water the appropriate amount proportional to the load applied to the dock. The bent ends 86 and sides 87 of member 80 in addition to assisting in resisting vertical movement through the water resist lateral movement of the baffle members through the water.

It is believed the ends 86 also add stability to a dock structure by resisting the rotary component of movement caused by the application of an unbalanced force to one side of the dock structure 82 and/or upsetting wave and wind forces. When a downward force is applied to the left side of dock 82 in FIG. 8, the upper right end 86 of the upper tray 84 will directly resist upward rotation of the right side of floating dock 82 that tends to occur. Similarly the lower left end 86 of the lower try 84 resists the lower rotation tendency created by the application of the unbalancing force. The other ends of the upper and lower trays 84 also help resist this rotation tendency. Similarly the sides of dishes 110 in FIG. 12 resist the rotational tendency caused by wave and/or unbalanced forces applied to the dock structure. Sides 106 of baffle members 100 resist both lateral and vertical movement through the water for certain applications adding frictional resistance to the displacement of the dock structure. Sides 106 will also resist rotational forces in a direction transverse thereto. In addition it has been found that the "trapping" of the water within the heart of the baffle members increases the stabilizing effect over flat plate baffles.

By substantially reducing the rate of tipping of a dock structure its stability and safety are greatly enhanced making it a much more desirable and marketable product.

Figure 12:
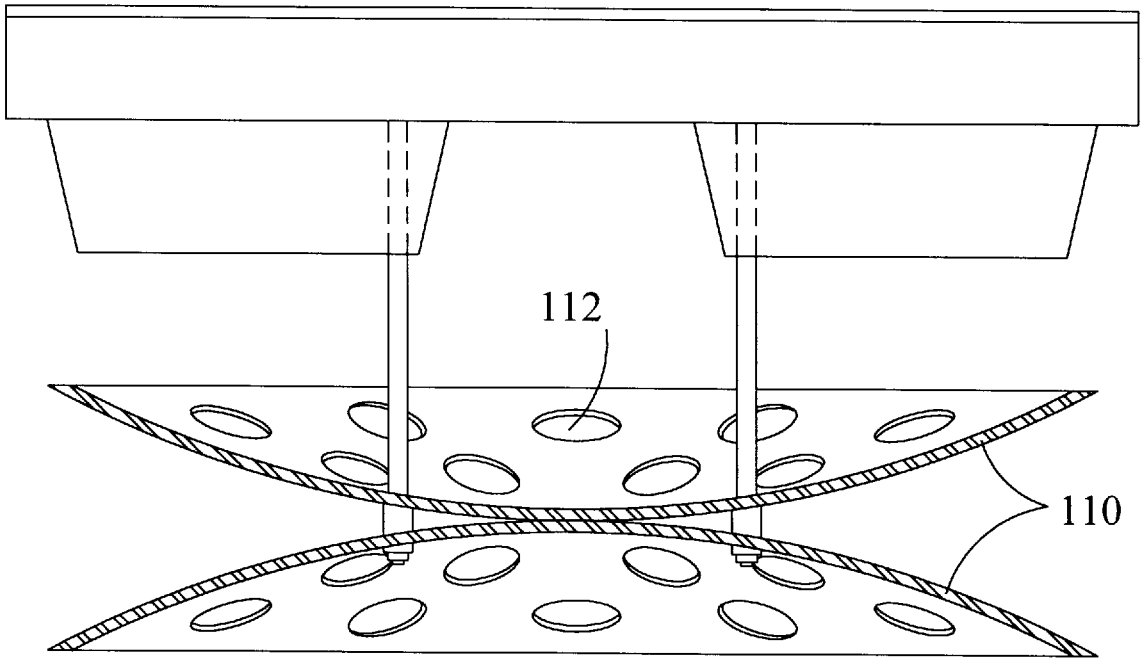
FIG. 12 is a view similar to FIG. 7 of a still further embodiment of the present invention.

Referring now to FIG. 12 there is shown a specialized form of baffle member namely dish 110. Dish 110 is shown having an elliptical shape and a depth approximately equal to the depth of the trays shown in FIGS. 7 & 8. The cylindriform surface of baffle 110 is the ultimate extension of a multi-planar baffle member, such as baffle 80, designed to inhibit lateral and rotational movement in any direction as well as vertical movement. Holes 112 are spaced about the entire surface of the baffle member 110 and function in a manner similar to the holes in the sides and ends of the trays of FIGS. 7–9.

Dish 110 is shown elliptical where the major diameter has a length greater than the length of one of the buoyant float drums and the maximum motion inhibiting effect will be along the direction of the minor diameter. Dish 110 if desired may be circular or any other desired shape for a particular application.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

I claim:

1. A stabilizing member for dock structures having a plurality of buoyant float drums supporting an upper frame portion and a generally flat top surface comprising:

a multi-planar movement inhibitor portion having a first rectilinear plate member adapted to be mounted a spaced distance below the bottom surfaces of said float drums;

said inhibitor portion plate member having a plurality of smaller plate members positioned in planes angularly disposed relative to each other and said first plate member over an area of said first plate member;

said area being at least as great as the bottom area of one of said buoyant float drums; and a plurality of holes formed in the surface of said inhibitor portion plate members;

whereby when said stabilizing member is mounted a spaced distance below a dock structure vertical and horizontal movement of said dock structure will be inhibited.

2. A stabilizing member according to claim 1 further including:

a first quantity of said smaller plate members being fixed to said first plate member at an angle extending upwardly therefrom: and a second quantity of said smaller plate members being fixed to said first plate member at an angle extending downwardly therefrom.

3. A stabilizing member as claimed in claim 2 wherein said smaller plate members extend away from said first flat plate member at an angle of between thirty degrees and ninety degrees.

4. A stabilizing member according to claim 1 wherein said inhibitor portion plate members comprises:

a pair of shallow tray members each having a bottom, sides and ends; and said tray members being fixed bottom to bottom with said sides and ends extending upwardly and downwardly respectively from said bottoms.

5. A stabilizing member for dock structures having a plurality of buoyant float drums supporting an upper frame portion and a generally flat top surface comprising:

a multi-planar movement inhibitor portion adapted to be mounted a spaced distance below the bottom surfaces of said float drums;

said inhibitor portion having a pair of shallow trough members each having a Vee shaped cross-section;

said trough members being fixed apex to apex with one facing upwardly and one facing downwardly;

said inhibitor portion having an area at least as great as the bottom area of one of said buoyant float drums; and a plurality of holes formed in the surfaces of said inhibitor portion;

whereby when said stabilizing member is mounted a spaced distance below a dock structure vertical and horizontal movement of said dock structure will be inhibited.

6. A stabilizing member according to claim 5 wherein said trough members are formed with an angle of from ninety to one hundred fifty degrees between the sides thereof.

7. A stabilizing member for dock structures having a plurality of buoyant float drums supporting an upper frame portion and a generally flat top surface comprising:

a multi-planar movement inhibitor portion adapted to be mounted a spaced distance below the bottom surfaces of said float drums;

said inhibitor portion having at least one shallow dish member having a curvilinear surface adapted to be mounted in a generally horizontal plane below the bottom surfaces of said float drums;

said inhibitor portion having an area at least as great as the bottom area of one of said buoyant float drums; and a plurality of holes formed in the surfaces of said inhibitor portion;

whereby when said stabilizing member is mounted a spaced distance below a dock structure vertical and horizontal movement of said dock structure will be inhibited.

8. A stabilizing member according to claim 7 wherein said said shallow dish member has a generally elliptical shape and the major diameter is greater than the length of one of said buoyant float drums.

* * * * *